US011447937B2

(12) United States Patent
Hernandez et al.

(10) Patent No.: US 11,447,937 B2
(45) Date of Patent: Sep. 20, 2022

(54) WEAR ASSEMBLY FOR EARTH WORKING EQUIPMENT

(71) Applicant: ESCO Group LLC, Portland, OR (US)

(72) Inventors: Abram Hernandez, Portland, OR (US); Yesenia Meraz-Torres, Gresham, OR (US); Christopher A. Johnston, Portland, OR (US)

(73) Assignee: ESCO GROUP LLC, Portland, OR (US)

( * ) Notice: Subject to any disclaimer, the term of this patent is extended or adjusted under 35 U.S.C. 154(b) by 139 days.

(21) Appl. No.: 16/785,544

(22) Filed: Feb. 7, 2020

(65) Prior Publication Data

US 2020/0256040 A1 Aug. 13, 2020

Related U.S. Application Data

(60) Provisional application No. 62/803,317, filed on Feb. 8, 2019.

(51) Int. Cl.
*E02F 9/28* (2006.01)

(52) U.S. Cl.
CPC ..... *E02F 9/2833* (2013.01); *E02F 9/2825* (2013.01)

(58) Field of Classification Search
CPC ..... E02F 9/2825; E02F 9/2833; E02F 9/2858
See application file for complete search history.

(56) References Cited

U.S. PATENT DOCUMENTS 1,918,841 A 7/1933 Finkl
2,032,875 A 3/1936 Graham
2,762,139 A 9/1956 Launder
2,896,345 A 7/1959 Peklay
3,082,555 A 3/1963 Hill
3,431,664 A 3/1969 Creager
3,704,753 A * 12/1972 Hasforth ..... E02F 9/2841 172/753
3,961,788 A * 6/1976 Helton ..... E02F 3/8152 172/701.2
4,129,934 A * 12/1978 Gettman ..... E02F 9/2875 37/453
4,317,300 A 3/1982 Emrich et al.
4,326,348 A 4/1982 Emrich
4,428,131 A 1/1984 Hahn
4,587,751 A 5/1986 Sjogren et al.
(Continued)

OTHER PUBLICATIONS

Hensley Industries, Inc., Brochure "Mining Products; Breakthrough," www.hensleyind.com, pp. 16, 2016.

*Primary Examiner* — Gary S Hartmann

(74) *Attorney, Agent, or Firm* — Steven Schad; Palmer Dzurella

(57) ABSTRACT

Wear caps protect the wearable surfaces of an adapter for an earth working equipment. These wear caps are subjected to erosion and wear by contact with abrasive material, such as experienced in an excavating operation. The wear caps can be attached to upper and lower legs of the adapter and protect them from wear. Each wear cap is secured to a retention feature on an independent mounting structure. The independent mounting structures are aligned and staggered such that installation of a wear cap onto the rearward independent mounting structure is conducted first. The independent mounting structures on an upper leg may be situated one above the other.

35 Claims, 8 Drawing Sheets

(56) References Cited

U.S. PATENT DOCUMENTS

| | | | | | |
|---|---|---|---|---|---|
| 4,716,667 | A | | 1/1988 | Martin | |
| 4,716,668 | A | | 1/1988 | Hahn | |
| 4,727,663 | A | | 3/1988 | Hahn | |
| RE33,454 | E | | 11/1990 | Potter | |
| 5,016,365 | A | * | 5/1991 | Robinson | E02F 9/2808 37/453 |
| 5,075,986 | A | | 12/1991 | Smith et al. | |
| 5,119,888 | A | * | 6/1992 | Hall | A01B 15/025 172/699 |
| 5,172,501 | A | | 12/1992 | Pippins | |
| 5,210,965 | A | | 5/1993 | Funk, Sr. et al. | |
| 5,337,495 | A | * | 8/1994 | Pippins | E02F 9/2808 37/456 |
| 5,666,748 | A | | 9/1997 | Emrich et al. | |
| 6,725,582 | B2 | | 4/2004 | Adamic et al. | |

* cited by examiner

WEAR ASSEMBLY FOR EARTH WORKING EQUIPMENT

RELATED APPLICATIONS

This application claims the benefit of priority from U.S. Provisional Patent Application No. 62/803,317, filed Feb. 8, 2019, the entirety of which is incorporated by reference.

FIELD OF THE DISCLOSURE

The present disclosure pertains to wear members for earth working equipment.

BACKGROUND OF THE DISCLOSURE

During mining and construction operations, replaceable teeth are commonly secured to earth working equipment for penetrating the ground and protecting the equipment, such as excavation buckets, from premature wear. The teeth are composed of wear members, such as an adapter and a point, that are held together by locks. During use, these wear members gradually wear down due to abrasive conditions and heavy loading. Once depleted, the wear members are removed from the equipment and replaced. Using such wear members provides a cost-effective approach to digging and other earth working operations because it lessens the need of having to repair or replace the more expensive underlying equipment such as the lip or other portions of the equipment.

Wear caps are at times installed on adapters to overlie surfaces subjected to high levels of wear to protect them and thereby increase their usable life. Wear caps are typically provided with a slot and are installed over a tongue formed on the wearable surface of the part to be protected. Wear caps, however, have also tended to possess various disadvantages such as imposing constraints on the design of the underlying part, being difficult to install or remove, causing reduced penetrability, and/or increasing manufacturing and/or inventory costs.

SUMMARY OF THE DISCLOSURE

The present disclosure pertains to excavating teeth and, in particular, to wear members comprising the teeth.

In one example, wear caps protect the wearable surfaces of an adapter subjected to erosion by contact with abrasive material, such as experienced in an excavating operation. The wear caps can be attached to the inner and outer surfaces of an adapter to protect the adapter rearward of the nose. Each wear cap is secured to a wearable surface by an independent mounting structure even when a plurality of wear caps overlies the same inner or outer surface.

In one other example, a wear assembly includes an adapter including at least one leg, and first and second wear caps mounted on the leg at separate first and second mounting stations.

In another example, an adapter is provided with one or two identical wear caps on each leg of the adapter, wherein the wear caps are independently mounted and substantially cover both legs.

In another example, an adapter is provided with two wear caps on one leg and a single wear cap on its other leg, wherein the wear caps are identical, are all secured on independent mounting structures, and collectively substantially cover both legs of the adapter.

In another example, an adapter for a wear assembly has a top leg that includes a front attachment feature and a rear attachment feature spaced and separate from the front attachment feature wherein each attachment feature mounts a wear cap to the adapter.

In another example, an adapter includes top and bottom legs to straddle a lip wherein one or more wear cap covers at least half of one or both legs. In one other such example, one or more wear cap covers at least 70% of one or both legs. In another such example, a plurality of wear caps covers at least 70% of the top leg. In another such example, a single wear cap covers at least 70% of the bottom leg.

In another example, a wear assembly for earth working equipment includes an adapter having a forwardly projecting nose and an inner surface rearward of the nose, wherein the inner surface has at least two independent retention structures, a wear member having a cavity that receives the nose, a lock to secure the wear member to the adapter, and a wear cap mounted on each of the independent retention structures.

In another example, an adapter for mounting on a base of an earth working equipment includes a forwardly projecting nose for mounting a wear member, an inner leg to extend over the base, and an inner surface rearward of the nose, wherein the inner surface extends over the inner leg and has at least two independent retention structures for mounting wear caps.

In another example, an adapter includes at least one rearward tapering dovetail slot for mounting a wear cap to facilitate an easier installation and/or removal of the wear cap.

In another example, an adapter for a wear assembly includes a top leg of reduced thickness to accommodate the use of wear caps for longer life but with reduced impact on the tooth's overall thickness, ability to penetrate the ground, and/or loading or unloading of the bucket. In one such example, the maximum thickness of the top leg is less than 35% of the maximum thickness of the adapter forward of the lip. In another such example, the maximum thickness of the top leg is less than 30% of the maximum thickness of the adapter forward of the lip. In another such example, the maximum thickness of the top leg is about 26% (e.g. within a range of plus 25.5% to 26.5%) of the maximum thickness of the adapter forward of the lip.

In another example, the adapter has a rear section rearward of the front of the lip, which includes top and bottom legs to straddle the lip of a bucket, and a front section forward of the lip, which includes a nose to mount a point forward of the lip, wherein the rear section has a reduced increase in thickness over the front section to accommodate the use of wear caps for longer life but with reduced impact on the tooth's overall thickness, ability to penetrate the ground, and/or loading or unloading of the bucket. In one such example, the rear section has a maximum thickness that is less than 10% more than the maximum thickness of the front section. In another such example, the rear section has a maximum thickness that is less than 9% more than the maximum thickness of the front section. In one other such example, the rear section has a maximum thickness that is only about 8.5% more than the maximum thickness of the front section.

In another example, an adapter includes adjacent lifting holes passing through a top leg to receive a hook or other means for lifting the adapter. In one such example, the top leg receives a wear cap over the holes.

In another example, an adapter for mounting on a base of an earth working equipment includes a forwardly projecting nose for mounting a wear member, an inner leg to extend over the base, an inner surface facing away from the base, and at least one hole in the inner surface extending generally toward the base and configured to receive a lifting hook for lifting the adapter.

DETAILED DESCRIPTION

Excavating teeth are commonly secured to the digging edge of earth working equipment (e.g., a bucket) to improve digging and protect the equipment against premature wear. As an example, a tooth may include an adapter secured to a bucket, and a point secured to the adapter. Alternatively, a tooth may include an intermediate adapter fit between the adapter and the point. The adapter may be a component secured to the lip (by welding or otherwise) or may be an integral portion of a cast lip including a forwardly projecting nose. Although points generally wear faster, adapters are also subjected to loading and abrasive conditions such that both components are considered wear members that need replacement after a period of use; e.g., during use, these wear members gradually wear down due to the abrasive conditions and heavy loading. Once depleted, the wear members are removed from the equipment and replaced. Using such wear members provides a cost-effective approach to digging and other earth working operations because it generally results in a smaller amount of discarded material when parts are replaced and lessens the need of having to repair or replace the more expensive underlying equipment such as the lip.

Figure 1:
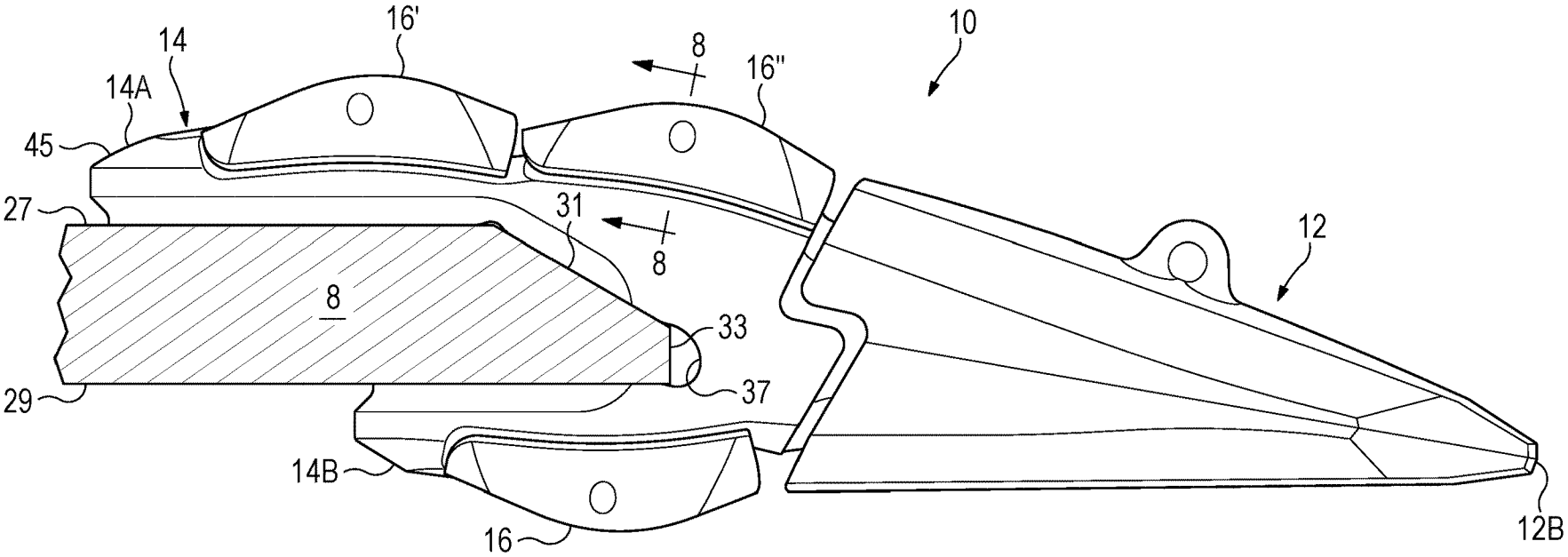
FIG. 1 is a side view of a wear assembly in accordance with the present disclosure in the form of a tooth with wear caps where the tooth is secured to a lip.
Figure 2:
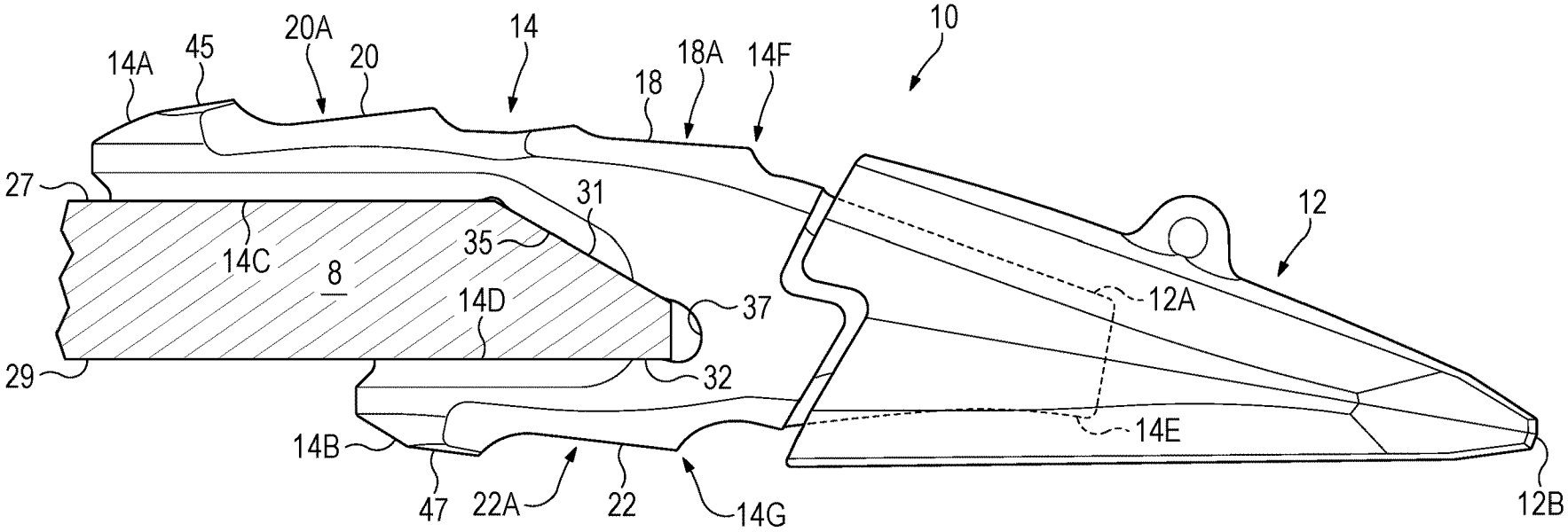
FIG. 2 is a side view of the wear assembly of FIG. 1 with the wear caps removed.

Adapters can have a number of different forms and be attached in different ways. In the example of FIG. 1, an adapter 14 is welded to a plate lip 8 of a bucket. Nevertheless, adapters can be secured in other ways such as by locks, bolts, etc. or can be an integral portion of the cast lip. Teeth can also be secured to other digging edges such as a bucket sidewall, a blade or a dredge cutter head. Adapters can generally support a plurality of successive points (or intermediate adapters) before wearing out and needing to be replaced. Wear caps are at times secured to exposed surfaces of the adapter as sacrificial components to extend the service life of the adapter. This is particularly beneficial when the adapters are welded to the lip as the removal and replacement processes are labor intensive and time consuming, often requiring the bucket (or other equipment) to be taken out of service. Although specific examples are discussed below, the inventive concepts contained herein are not limited to these examples.

Referring to the example illustrated in FIGS. 1-8, a lip 8 of a bucket has an inner or upper surface 27, an outer or lower surface 29, a ramp or chamfer 31 and a front surface 33 (FIG. 1). A wear assembly 10 includes an adapter 14 secured to the lip 8, and a point 12 secured to the adapter 14. The adapter 14 includes rearward extending legs 14A and 14B that straddle and are welded to the lip 8, and a forward facing nose 14E that is received in a cavity 12A in point 12 (FIGS. 1-2) to support the point. The adapter 14 further includes inner and outer surfaces 14F, 14G that extend rearward from the nose 14E and over legs 14A, 14B. A lock 13 is received in holes 15, 17 in the point and adapter, respectively, to releasably secure the point 12 to the adapter 14. A cavity 35 defined by the interior surfaces 14C, 14D of legs 14A, 14B receives the lip 8. The inner leg 14A overlies the ramp 31 and a portion of the inner surface 27 of the lip 8. The outer leg 14B overlies a portion of the outer surface 29 of the lip 8. A relief 37 is provided at the front end of cavity 35 to avoid bearing against front surface 33. Other constructions are possible. As examples, the lip could be formed without a ramp, the adapter could abut the front end of the lip, etc.

The adapter 14, rearward of point 12, is substantially protected from wear by wear caps 16. The wear caps 16, 16', 16" are preferably identical though differences are possible. The use of identical wear caps 16, 16', 16" reduces manufacturing and inventory costs and eases their use in earth working operations (e.g., in a mine) by eliminating the prospect of mixing up similar looking wear caps. Moreover, the wear caps 16, 16', 16" and inner and outer surfaces 14F, 14G (and legs 14A, 14B) are cooperatively dimensioned so that identical wear caps 16, 16', 16" substantially cover both the inner and outer surfaces 14F, 14G as well as the top leg 14A and the bottom leg 14B; in the illustrated example, the inner and outer surfaces extend forward of the legs up to the nose.

One beneficial arrangement, as shown, includes two wear caps 16', 16" to substantially cover the inner surface 14F (and top leg 14A) and one wear cap 16 to substantially cover the outer surface 14G (and bottom leg 14B) to maximize the design of the legs 14A, 14B and minimize the number of required wear caps 16, 16', 16" where all three of the wear caps 16, 16', 16" are identical (FIG. 1). Of course, other arrangements with differing numbers of wear caps on each leg are possible. As examples only, three wear caps could be used to substantially cover the top leg 14A and/or two wear caps could be used to substantially cover the bottom leg 14B. Moreover, some or all of wear caps could have different shapes, sizes and/or mounting configurations.

Each wear cap 16, 16', 16" is preferably secured to a discrete mounting station 18A, 20A, 22A to provide more flexibility in the leg design, and/or enable easier installation and/or removal of the wear caps 16, 16', 16". For example, in the illustrated example, the use of separate stations 18A, 20A, 22A enables the use of an adapter 14 with a slimmer profile (i.e., primarily using a thinner top leg) for better ground penetration, and less impediments to filling and dumping the bucket. The separate mounting stations in this example also permit the use of an easier and quicker installation and removal process for the wear caps 16, 16', 16" as compared to feeding successive wear caps along continuous (e.g., linear) rails or grooves formed in the adapter. In this example, top or inner leg 14A includes front and rear mounting stations 18A, 20A, and bottom or outer leg 14B includes mounting station 22A.

Figure 7:
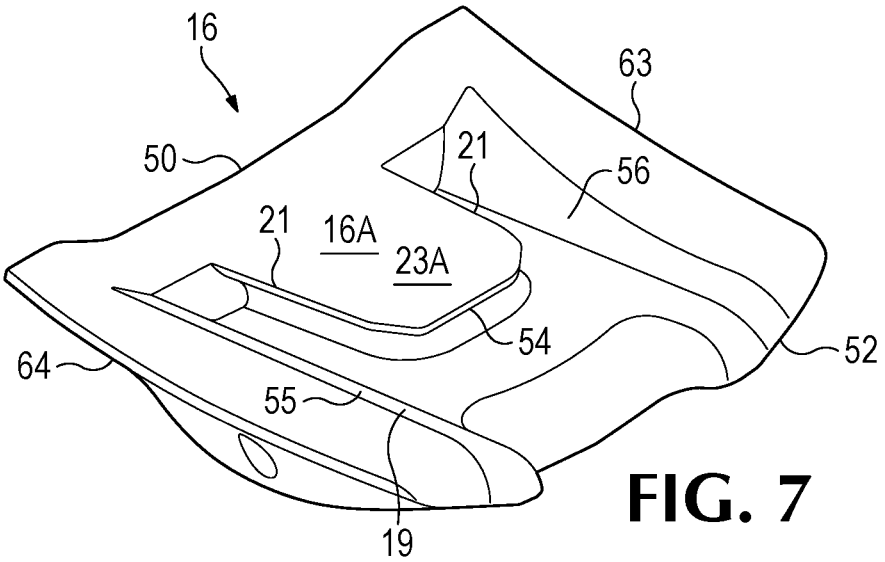
FIG. 7 is an inner perspective view of the wear cap of FIG. 1.
Figure 8:
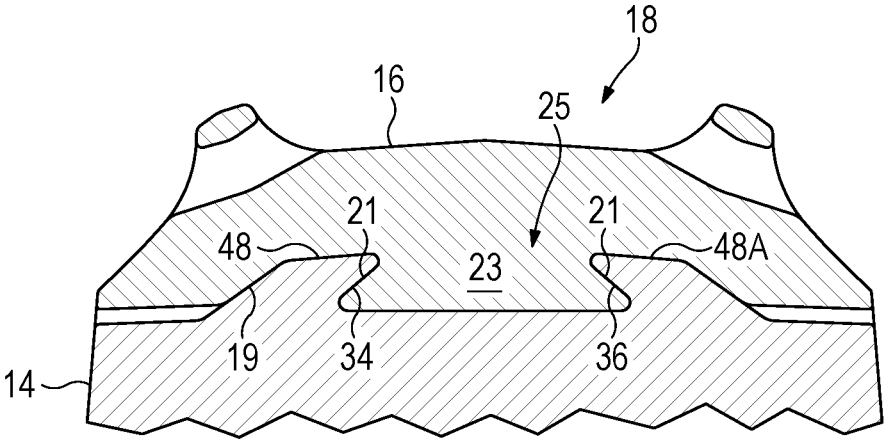
FIG. 8 is a cross sectional view taken along line 8-8 in FIG. 1.

Referring to FIG. 7, the wear caps 16, 16', 16" are identical with each having a forward end 50 and a rear end 52. The wear cap 16 includes an interior surface 19 with an attachment feature 16A, and an outer surface 16B that contacts earthen or other abrasive materials during operation. The interior surface 19 has edges 55, 56 on either side that forwardly diverge. The exterior surface 16B may be dome shaped or include ramped surfaces 57, 58 and top surfaces 59, 60. The top surface 60 may be angled downwardly towards the front end 50 of the wear cap 16. Other configurations are possible.

Each mounting station 18A, 20A, 22A is centrally located and includes a front surface 38, a back surface 40, a retention feature 18, 20, 22 to complement and engage attachment features 16A for securing the wear caps 16, 16', 16" to the adapter 14. In the illustrated embodiment, the rearward mounting station 20A on inner surface 14C is staggered and oriented differently from mounting station 18A. More specifically, mounting station 20A is situated slightly above mounting station 18A and/or at somewhat different inclinations such that they do not align, so that they are independent of each other. Each wear cap is fit onto the adapter by engaging its particular mounting station without having to first traverse over a different mounting station. As an example, the wear cap 16' is mounted on mounting station 20A without having to first traverse mounting station 18A.

The retention elements 18, 20, 22 each includes a forward-opening dovetail slot 25 having tapered side surfaces 34, 36, a bottom surface 25A, and a stop 42. The tapered side surfaces 34, 26 converge rearwardly. The stop 42 acts a barrier or end for the attachment feature 16A of the wear cap 16, 16', 16" and may further include stepped surfaces 42A. The stepped surfaces 42A are adjacent a sloped or curved surface 44 that connects the dovetail slot 25 to the back surface 40 of the retention feature 18, 20, 22. Adjacent the back surface 40 lies a mound surface 46. The mound surface 46 is adjacent an arched or curved surface 48, 48A. The length of the arched surfaces 48, 48A are from substantially the beginning of the dovetail slot 25 to the end of the mounting station 18A, 20A, 22A. The arched surfaces 48, 48A are adjacent the outer surface 45, 47. The arched surfaces 48, 48A may angle inward at the entrance of the dovetail slot 25 to aid in the introduction the attachment feature 16A of the wear cap 16, 16', 16". While this one example is disclosed, the mounting stations could have different kinds of retention elements.

The attachment feature 16A can be a male or female element to receive the other of a male or female element in the retention feature. As examples only, the attachment and retention features 16A, 18, 20, 22 can each have a tapered dovetail configuration as shown in FIG. 1-8. In another example, the male and female features could be reversed from those shown with the male attachment feature on the leg and the female portion on the wear cap 16, 16', 16". Other attachment arrangements are possible including, for example, bolts, pins, etc.

Figure 9:
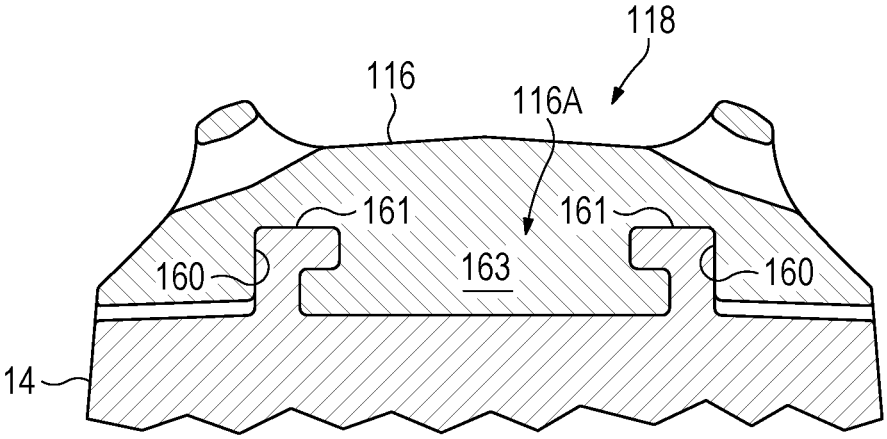
FIG. 9 is a cross sectional view of an alternative adapter leg and a wear cap at the same location as FIG. 8.

In an alternative, as seen in FIG. 9, a wear cap 116 having a T-shaped tongue and groove configuration is shown. The retention arrangement 118 includes a tongue groove 160 that is shaped like an inverted letter T. The retention arrangement 118 further includes two mirrored inverted L-shaped projections 161. The attachment arrangement 116A includes a T-shaped projection 163 that is sized and shaped to fit into the tongue slot 160. Other attachment arrangements are possible including, for example, bolts, pins, etc.

In the example shown in FIG. 1-8, the attachment feature 16A is a tapered dovetail shaped projection or wedge 23 received in a forward-opening tapered dovetail slot 25 that tapers rearwardly. The dovetail projection 23 tapers rearwardly to an end surface 54. The end surface 54 may engage a stop 42 when installed. The dovetail slot 25 securely holds the wear cap 16, 16', 16" against loss while providing an easier and/or quicker installation and/or removal process. For instance, wear caps with parallel rails, commonly used in conventional wear caps, can bind and get caught up due to friction interference during installation and/or removal. Moreover, earthen fines can collect in the gaps between the adapter and the wear cap worsening the risk of binding movement of the cap during installation and removal, and especially during removal. By using a tapered slot 25, disengagement between the wear cap 16, 16', 16" and the adapter 14 occur with the initial movement of the wear cap 16, 16', 16", and the fines tend to fall out as the wedge 23 is loosened and release from the retention feature 18, 20, 22. These ease installation and/or removal of the wear cap from the adapter and avoids having the cap 16, 16', 16" become "cemented" into the wear assembly 10 (i.e., by earthen fines). To install the wear caps 16, 16', 16", the wear cap 16, 16', 16" is first positioned on the leg 14A, 14B forward of its seated position and moved rearward so the dovetail projection 23 is received fully into the dovetail slot 25. The dovetail shaped projection 23 received in the forward-opening dovetail slot 25 in that tapers rearwardly. The dovetail projection 23 includes side surfaces 21 and a top surface 23' that taper rearwardly to match with the complementary surfaces 25A, 34, 36 of the retention feature 18, 20, 22 on the adapter 14.

In the illustrated example, the rear wear cap 16' is installed into mounting structure 20 first followed by the front wear cap 16" into mounting structure 18. The front wear cap 16", then, blocks the forward advance and release of the rear wear cap 16', and the point 12 blocks the forward advance and release of the front wear cap 16'. The wear cap 16 on the lower leg 14B is similarly installed into mounting structure 22 and similarly held in position by the installed point 12. The configuration shown is an example.

One or more of the wear caps 16, 16', 16" could alternatively be secured by a lock or other mechanical means. The attachment features 16A are preferably formed (e.g., by casting) in place with the component, but they could be welded or otherwise secured to the component.

Figure 5:
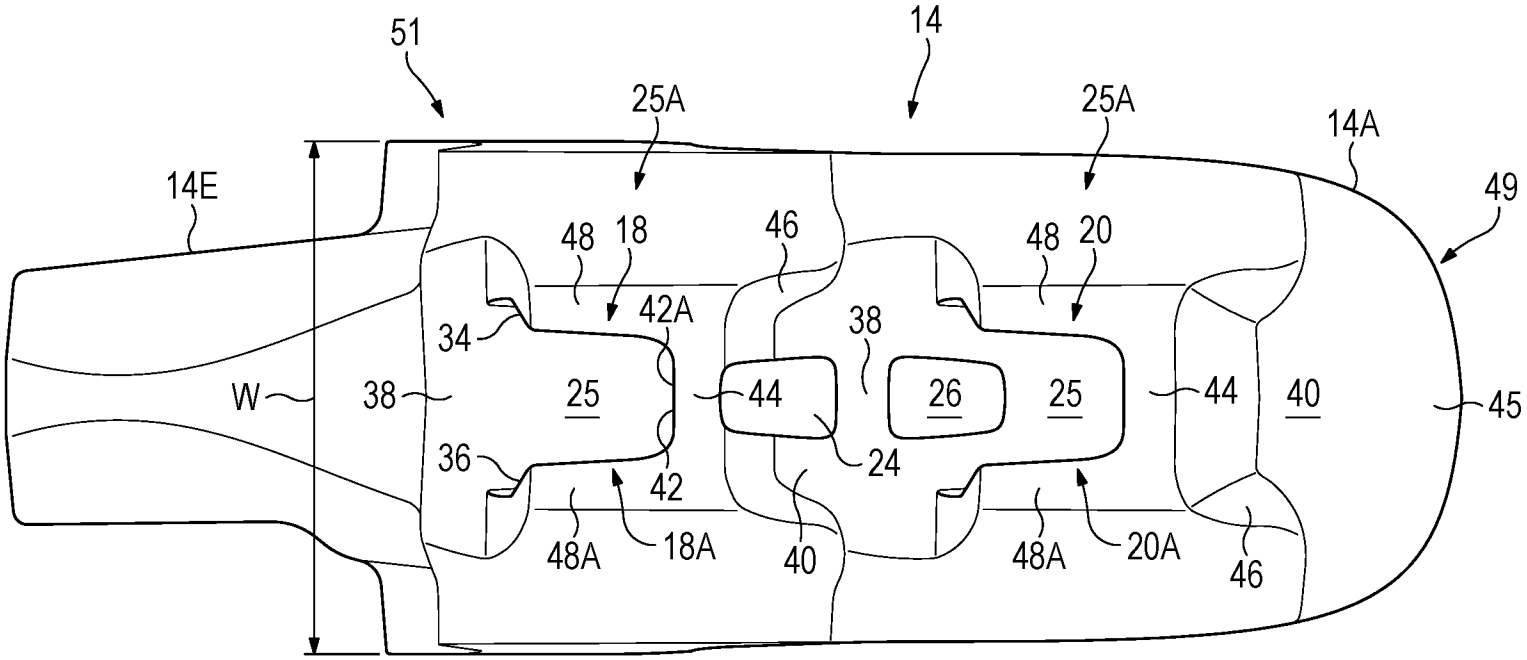
FIG. 5 is a top view of the adapter of FIG. 1.
Figure 6:
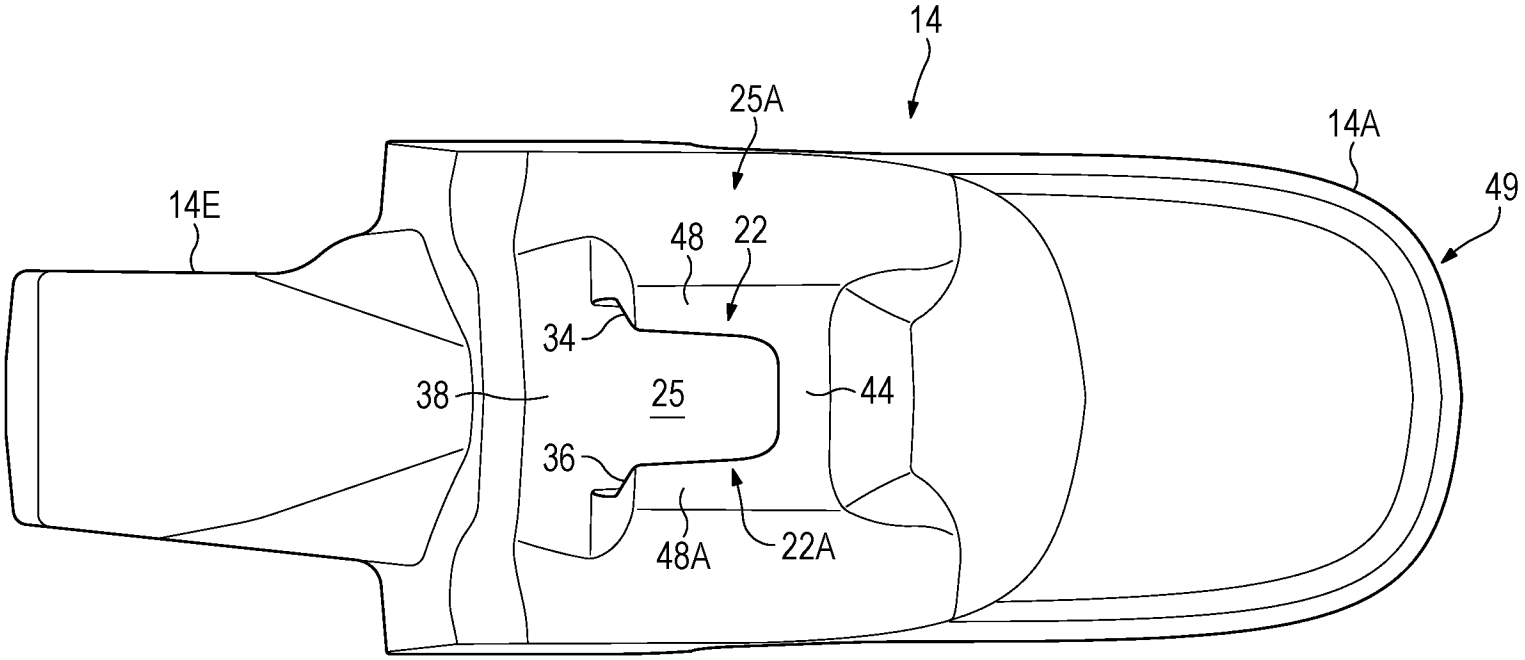
FIG. 6 is a bottom view of the adapter of FIG. 1.

The attachment features 16A in the example of FIGS. 1-8 are spaced from the outside sides 63, 64 and edges 55, 56 of the wear cap 16, 16', 16" and centered on the wear cap 16, 16', 16". Conventional wear caps are secured by rails and groove extending along the outside edges of the cap and adapter legs. However, with this arrangement, erosion of the wear caps could ultimately expose the rails and grooves securing the wear cap leading to possible loss of the wear cap and/or premature wearing and replacement of the adapter. This can necessitate early replacement of the wear cap, and/or premature damage to the adapter requiring its early replacement as well. With the attachment features 16A spaced from the edges 55, 56 and sides 63, 64 of the wear caps 16, 16', 16" in the illustrated example, they are remote from the most exposed surfaces 16B to erosion so as to extend the service life of the wear cap 16, 16', 16" and/or the adapter 14. The wear caps 16, 16', 16" preferably extend over the entire width W of the leg 14A, 14B but can extend less than the width W of the leg 14A, 14B (FIG. 5-6). Alternatively, the wear cap 16, 16', 16" can extend beyond the width W of the leg 14A, 14B to overlap the welds holding the adapter 14 to the lip 8.

Figure 3:
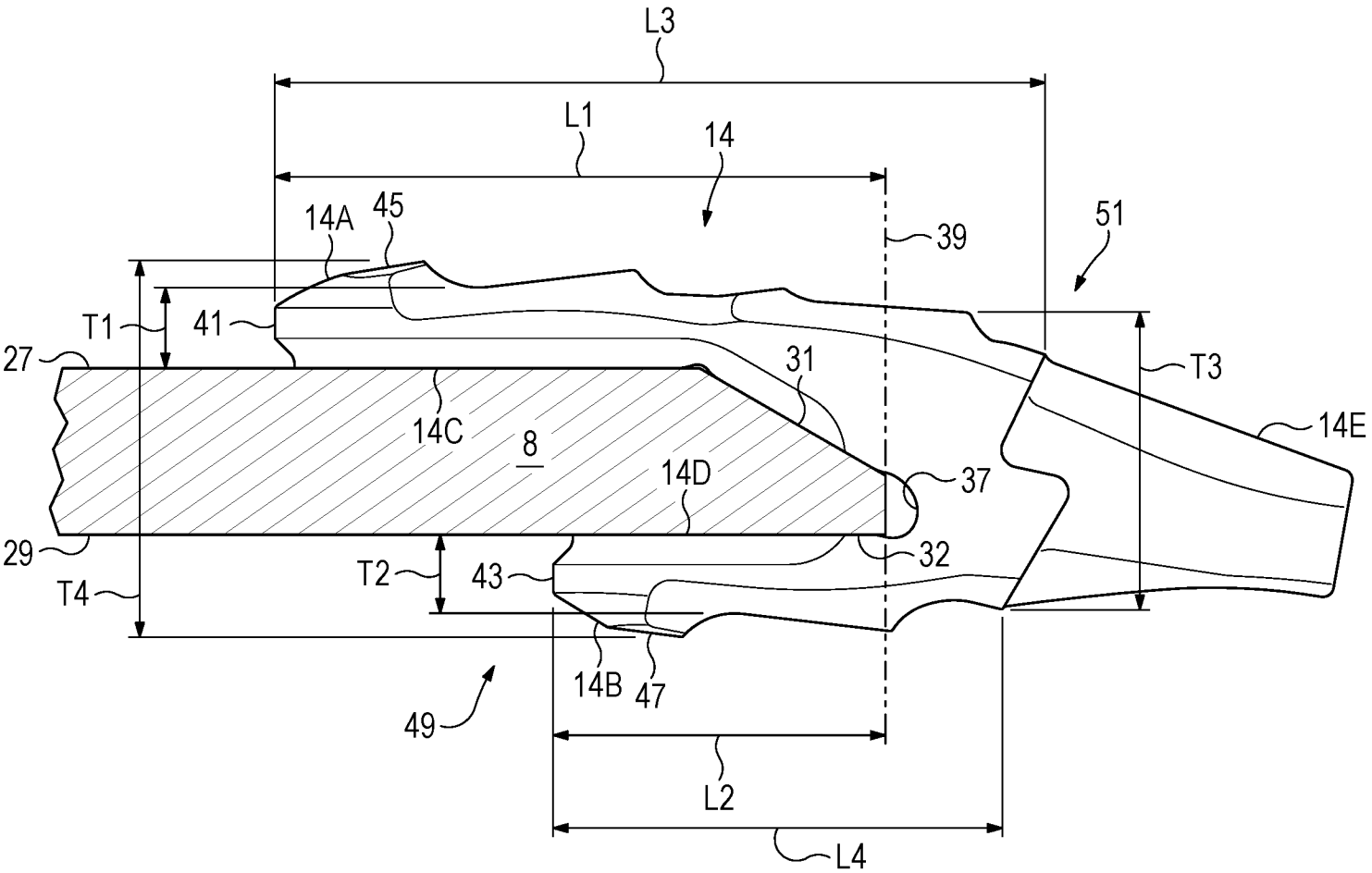
FIG. 3 is a side view of an adapter of FIG. 1.
Figure 4:
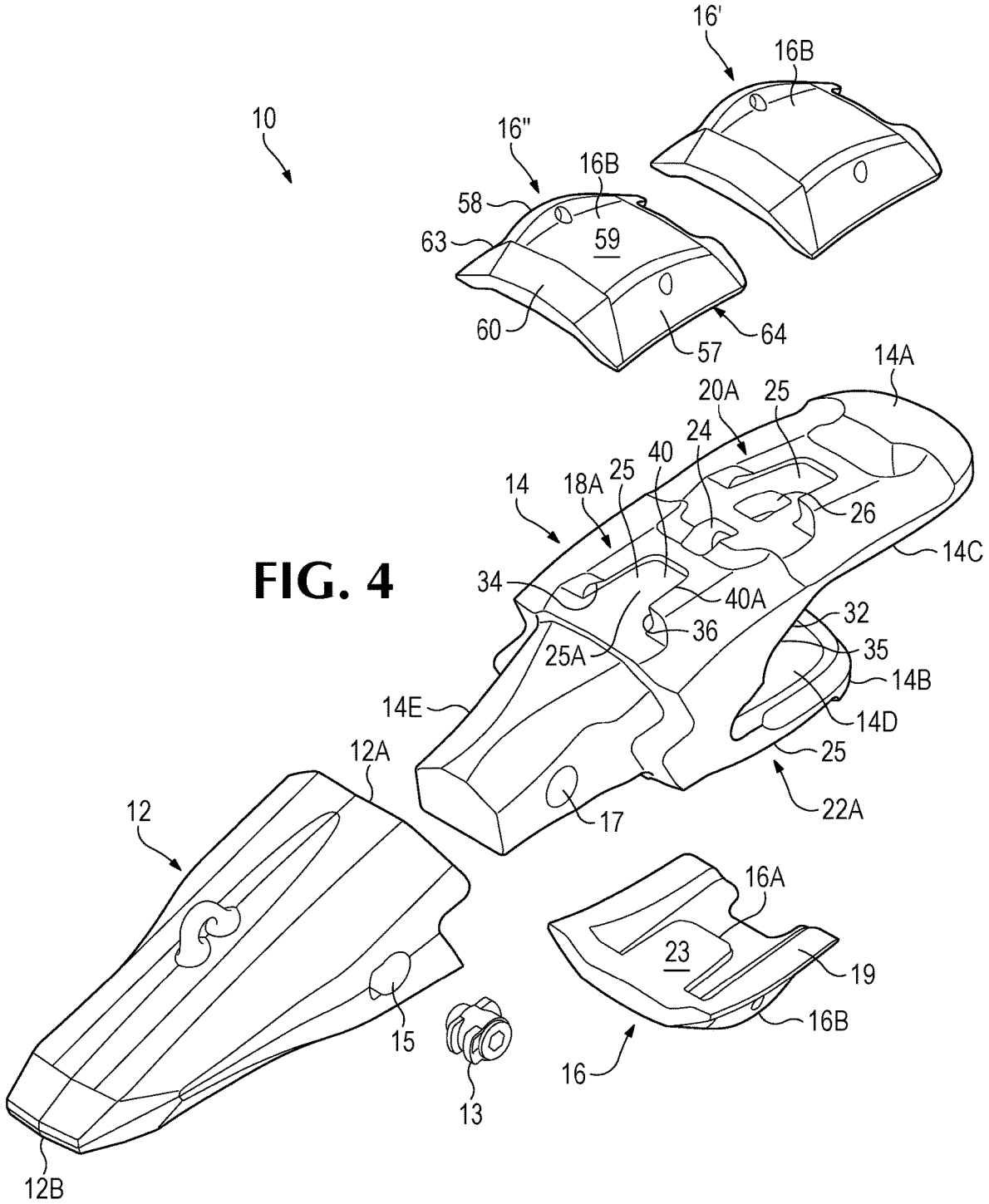
FIG. 4 is an exploded, perspective view of the wear assembly of FIG. 1.

As seen in FIG. 3, a length L1, L2 of each leg 14A, 14B is defined as a distance between a datum or vertical plane 39 aligned with a front surface 33 and a rear end 41, 43 of the leg 14A, 14B. The adapter 14, rearward of point 12, is substantially protected from wear by wear caps 16, 16', 16".

As noted above, the wear caps 16, 16', 16" preferably substantially cover both legs 14A, 14B of the adapter 14, which in this application means the wear caps 16, 16', 16" extend over 50% of the lengths L3, L4 of the inner and outer surfaces 14F, 14G and/or the lengths L1, L2 of the legs 14A, 14B. The wear cap(s) 16, 16', 16" preferably extend over 70% of the lengths L3, L4 of the inner and outer surfaces 14F, 14G and/or the lengths L1, L2 of each leg 14A, 14B. The inner surface 14F is shown with two wear caps 16', 16". Alternatively, the inner surface 14F can receive more or fewer wear caps. The outer surface 14G is shown with one wear cap 16. Alternatively, the outer surface 14G can have a similar configuration as the inner surface receiving multiple wear caps.

The preferred attachment features 16A and/or use of discrete mounting stations 18A, 20A, 22A can lead to a slimmer adapter 14, which can result in lower costs, less weight, better penetration and/or less stress concentration. In one such example shown in FIG. 3, the slimmer profile can be obtained primarily from a slimmer inner leg 14A. The thickness T1 of the inner leg 14A is defined by the vertical distance between the lip 8 and a lowest point of the curved surface 44 of the retention feature 18 on leg 14A without considering any additional thickness that may be the result of a lifting eye. The vertical distance extends perpendicular to the inner and outer surfaces 27, 29 of the lip 8. When the inner and outer surfaces 27, 29 are not parallel (such as where the ramp is present or with a cast lip), the vertical distance is perpendicular to the axis of the lip. The thickness T2 of the outer leg 14B is defined by the vertical distance between the lip 8 and a lowest point of the curved surface 44 of the retention feature 22 on leg 14B.

In one such example, a thickness T1 is measured from the bottom of the inner leg 14A to a lowest point of the curved surface 44. A maximum thickness T1 of the inner leg 14A is less than 35% of the maximum thickness T3 of the adapter 14 forward of the lip 8. In another such example, the maximum thickness T1 of the inner leg 14A is less than 30% of the maximum thickness T3 of the adapter 14 forward of the lip 8. In another such example, the maximum thickness T1 of the inner leg 14A is about 26% (e.g. within a range of plus 25.5% to 26.5%) of the maximum thickness T3 of the adapter 14 forward of the lip 8.

The slimmer profile may be part of an overall design such that the overall thickness of the legs 14A, 14B is reduced compared to conventional adapters. The adapter 14 has a rear section 49 rearward of the front 33 of the lip 8 (i.e., rearward of the datum 39 aligned with the designated location of front surface 33), which includes top and bottom legs 14A, 14B to straddle the lip 8 of a bucket, and a front section 51 forward of the lip 8 (i.e., forward of the datum 39), which includes a nose 14E to mount a point 12 forward of the lip 8.

In one such example with a slimmer profile, the rear section 49 has a reduced increase in thickness over the front section 51 to accommodate the use of wear caps 16', 16" for longer life but with reduced impact on the tooth's overall thickness, ability to penetrate the ground, and/or loading or unloading of the bucket. In one such example, the rear section 49 has a maximum thickness T4 that is less than 10% more than the maximum thickness T3 of the front section 51. In another such example, the rear section 49 has a maximum thickness T4 that is less than 9% more than the maximum thickness T3 of the front section 51. In one other such example, the rear section 49 has a maximum thickness T4 that is only about 8.5% more than the maximum thickness T3 of the front section 51.

Adapters can be heavy. As a result, conventional adapters may be provided with a lifting eye extending from the top leg to receive a hook or clevis to support the member during installation. The lifting eyes can be troublesome to cast and securing the lifting eyes by welding can increase costs, reliability and/or the toughness of the steel. Moreover, at the end of service life, these eyes are typically worn away. In the illustrated example, adapter 14 includes a two adjacent openings 24 and 26 passing through top leg 14A and generally extending toward the base, though one hole with an undercut could be used. These holes 24, 26 are sized to receive a hook or other lifting tool to support the adapter by a crane and cable or other method during installation and removal. The use of these holes 24, 26 as opposed to a conventional protruding lifting eye can be easier to manufacture than conventional lifting eyes and will likely still be accessible at the time of removal from the lip 8. The use of such lifting holes 24, 26 can also facilitate broader coverage of the adapter legs 14A, 14B with wear caps 16, 16', 16" and lead to a greater service life. As can be seen in FIG. 5, the lifting holes 24, 26 are within the mounting structures 18A, 20A to be set beneath the wear caps 16, 16', 16", though they need not be. Positioned under the wear caps 16', 16", the top leg 14A with the holes 24, 26 will be protected from erosion and provide a safe method of removal of the adapter 14. The holes 24, 26 do not interfere with installation of the wear caps 16, 16', 16" to the adapter 14. Use of such lifting holes 24, 26 can reduce costs, improve reliability, enhance safety, and/or lead to longer service lives for the adapters 14.

Figure 10:
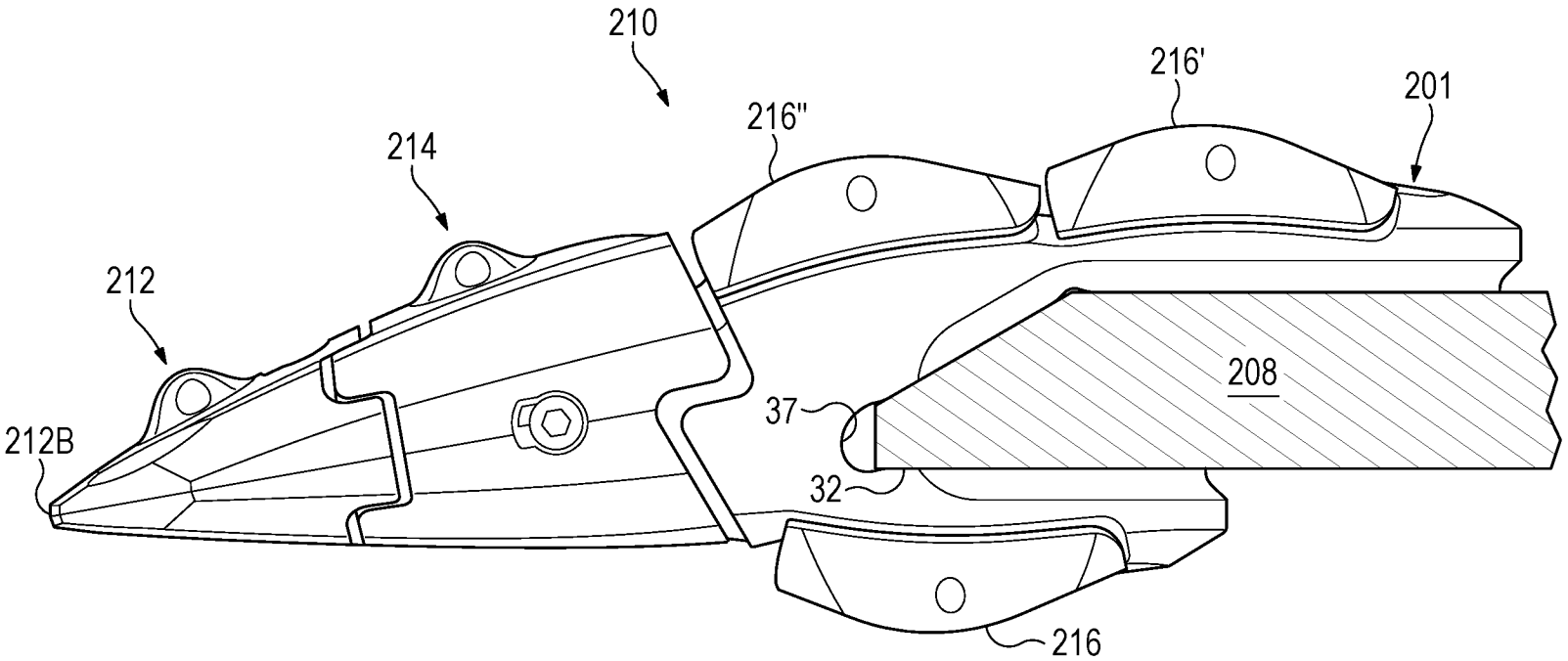
FIG. 10 is a side view of an alternative wear assembly in accordance with the present disclosure.

Referring to FIG. 10, a wear assembly 210 includes a point 212, an intermediate adapter 214 mounted to the point 212 and a base adapter 208 mounted to the intermediate adapter 214. The wear assembly 210 is substantially similar to the wear assembly of FIGS. 1-8, with the exception of the base adapter 201. The base adapter 208 may further include mounting structures 218 and wear caps 216 secured to the mounting structures as discussed above for adapter 14.

In another alternative, the intermediate adapter 214 may include a set of two mounting structures on the upper leg and one on the lower leg as is previously described. This configuration may also include the base adapter having wear caps and mounting structures as previously described above. It is also foreseen that an integral portion of a cast lip including a set of mounting structures for two identical, aligned, and staggered wear caps.

The wear caps and wear assemblies presented here provide improved protection to limit erosion of critical components extending their service life and reducing downtime to replace components. It should be appreciated that although selected examples of the representative wear caps are disclosed herein, numerous variations of these examples may be envisioned by one of ordinary skill that do not deviate from the scope of the present disclosure. This presently disclosed wear assemblies lend themselves to use with many different configurations of wear caps.

This disclosure encompasses multiple distinct inventions with independent utility. The various features of the invention described above are preferably included in each assembly. Nevertheless, the features can be used individually in a wear assembly to obtain some benefits of the invention. While each of these inventions has been disclosed in its preferred form, the specific examples thereof as disclosed and illustrated herein are not to be considered in a limiting sense as numerous variations are possible. Each example defines an example disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

We claim:

1. A wear assembly for earth working equipment comprising:

an adapter including a forwardly projecting nose and a leg extending rearward of the nose that is adapted to overlie and be secured to a digging edge of a bucket, the leg having a first surface to face the digging edge and an opposite second surface, wherein the inner second surface has at least two independent retention structures;

a wear member having a cavity that receives the nose;

a lock to secure the wear member to the adapter; and a plurality of wear caps, wherein each said wear cap is mounted on a different one of the at least two independent retention structures.

2. The wear assembly of claim 1 wherein the adapter includes a second leg, wherein the two legs are spaced apart to straddle the digging edge.

3. The wear assembly of claim 2 wherein the second leg has a first surface to face the digging edge and an opposite second surface, the second surface has an independent retention structure, and a wear cap is mounted on the independent retention structure on the second leg.

4. The wear assembly of claim 3 wherein the wear caps are identical to each other.

5. The wear assembly of claim 3 wherein the wear caps cover at least 50% of the second surface of each of the legs.

6. The wear assembly of claim 3 wherein the wear caps cover at least 70% the second surface of each of the legs.

7. The wear assembly of claim 3 wherein a maximum thickness of the adapter that extends along the digging edge is no more than 10% thicker than a maximum thickness of the adapter forward of the digging edge.

8. The wear assembly of claim 3 wherein a maximum thickness of the adapter that extends along the base is no more than 9% thicker than a maximum thickness of the adapter forward of the base.

9. The wear assembly of claim 3 wherein a maximum thickness of the adapter that overlies the digging edge is no more than 8.5% thicker than a maximum thickness of the adapter forward of the digging edge.

10. The wear assembly of claim 1 wherein a maximum thickness of the leg is less than 35% of a maximum thickness of the adapter forward of the digging edge.

11. The wear assembly of claim 1 wherein a maximum thickness of the leg is less than 30% of a maximum thickness of the adapter forward of the digging edge.

12. The wear assembly of claim 1 wherein a maximum thickness of the leg is about 26% of a maximum thickness of the adapter forward of the digging edge.

13. The wear assembly of claim 1 wherein the wear caps cover at least 50% of the second surface.

14. The wear assembly of claim 1 wherein the wear caps cover at least 70% the second surface.

15. The wear assembly of claim 1 wherein a maximum thickness of the adapter that extends along the digging edge is no more than 10% thicker than a maximum thickness of the adapter forward of the digging edge.

16. The wear assembly of claim 1 wherein a maximum thickness of the adapter that extends along the digging edge is no more than 9% thicker than a maximum thickness of the adapter forward of the digging edge.

17. The wear assembly of claim 1 wherein a maximum thickness of the adapter that extends along the digging edge is no more than 8.5% thicker than a maximum thickness of the adapter forward of the digging edge.

18. The wear assembly of claim 1 wherein the wear caps are identical to each other.

19. The wear assembly of claim 1 wherein the adapter includes at least one lifting hole on the second surface to receive a hook for lifting the adapter.

20. The wear assembly of claim 19 wherein at least one of the wear caps covers the at least one lifting hole.

21. The wear assembly of claim 1 wherein the wear member is a point having a front earth-penetrating end.

22. The wear assembly of claim 1 wherein the wear member is an intermediate adapter having a front nose for mounting a point.

23. The wear assembly of claim 1, wherein at least two wear caps are positioned one behind the other on the leg to define a front wear cap and a rear wear cap.

24. The wear assembly of claim 23, wherein the front wear cap is closer to the digging edge than the rear wear cap.

25. An adapter for earth working equipment, the adapter comprising a forwardly projecting nose for mounting a wear member, a leg extending rearward of the nose that is adapted to overlie and be secured to a digging edge of a bucket, the leg having a first surface to face the digging edge and an opposite second surface, and at least two independent retention structures for mounting wear caps, wherein each of the independent retention structures is for mounting a different wear cap.

26. The adapter of claim 25 wherein a maximum thickness of the leg is less than 35% of a maximum thickness of the adapter forward of the digging edge.

27. The adapter of claim 25 wherein a maximum thickness of the leg is less than 30% of a maximum thickness of the adapter forward of the digging edge.

28. The adapter of claim 25 wherein a maximum thickness of the leg is about 26% of a maximum thickness of the adapter forward of the digging edge.

29. The adapter of claim 25 including a second leg, wherein the two legs are spaced apart to straddle the digging edge, and the second leg has an independent retention structure for mounting a wear cap.

30. The adapter of claim 29 wherein a maximum thickness of the adapter that extends along the digging edge is no more than 10% thicker than a maximum thickness of the adapter forward of the digging edge.

31. The adapter of claim 29 wherein a maximum thickness of the adapter that extends along the digging edge is no more than 9% thicker than a maximum thickness of the adapter forward of the digging edge.

32. The adapter of claim 29 wherein a maximum thickness of the adapter that extends along the digging edge is no more than 8.5% thicker than a maximum thickness of the adapter forward of the digging edge.

33. The adapter of claim 25, wherein at least two wear caps are positioned one behind the other on the inner leg to define a front wear cap and a rear wear cap.

34. The adapter of claim 33, wherein the front wear cap is closer to the digging edge than the rear wear cap.

35. A wear assembly for earth working equipment comprising:

an adapter including a forwardly projecting nose and an inner surface rearward of the nose, wherein the inner surface has at least two independent retention structures;

a wear member having a cavity that receives the nose;

a lock to secure the wear member to the adapter; and a front wear cap and a rear wear cap mounted on the at least two independent retention structures, and wherein the front wear cap is closer to the digging edge than the rear wear cap.

* * * * *